US011196173B1

(12) United States Patent
Rmili et al.

(10) Patent No.: US 11,196,173 B1
(45) Date of Patent: Dec. 7, 2021

(54) DUAL-BAND (S AND C) SUB-REFLECTORS FOR FREQUENCY-REUSE TYPES OF SATELLITE COMMUNICATION SYSTEMS FOR COMMERCIAL AND DEFENSE APPLICATIONS

(71) Applicant: KING ABDULAZIZ UNIVERSITY, Jeddah (SA)

(72) Inventors: Hatem Malek Rmili, Jeddah (SA); Majed Nour, Jeddah (SA); Raj Mittra, Jeddah (SA); Asim Ghalib, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 0 days.

(21) Appl. No.: 17/358,187

(22) Filed: Jun. 25, 2021

(51) Int. Cl.

| | |
|---|---|
| ***H01Q 15/00*** | (2006.01) |
| ***H01Q 5/307*** | (2015.01) |
| ***H01Q 21/26*** | (2006.01) |
| ***H01Q 19/17*** | (2006.01) |
| ***H01Q 19/19*** | (2006.01) |

(52) U.S. Cl.
CPC ..... *H01Q 15/0013* (2013.01); *H01Q 5/307* (2015.01); *H01Q 19/17* (2013.01); *H01Q 19/19* (2013.01); *H01Q 21/26* (2013.01)

(58) Field of Classification Search
CPC .... H01Q 15/0013; H01Q 5/307; H01Q 19/17; H01Q 19/19; H01Q 21/26
See application file for complete search history.

(56) References Cited

U.S. PATENT DOCUMENTS

| | | | | |
|---|---|---|---|---|
| 5,471,224 A * | 11/1995 | Barkeshli | H01Q 19/195 | 343/909 |
| 6,198,457 B1 * | 3/2001 | Walker | H01Q 1/005 | 343/840 |
| 6,512,485 B2 * | 1/2003 | Luly | H01Q 1/247 | 343/753 |
| 2003/0234745 A1 * | 12/2003 | Choung | H01Q 19/195 | 343/781 P |

* cited by examiner

*Primary Examiner* — Andrea Lindgren Baltzell
*Assistant Examiner* — Amal Patel
(74) *Attorney, Agent, or Firm* — W&C IP

(57) ABSTRACT

Subreflectors for frequency-reuse types of satellite communication system which cover the S and C bands take the form of a three-dimensional waveguide with cross dipoles on each end, where each branch of each dipole is electrically connected by conductor that passes through the center of a substrate that fills the volume of the waveguide. The frequency selective surface sub-reflector is configured to permit the S-band antenna to transmit therethrough with an insertion loss of less than 0.5 decibels, and to reflect transmissions of the C-band antenna with transmissions through the frequency selective surface sub-reflector being less than 15 decibels.

11 Claims, 7 Drawing Sheets

DUAL-BAND (S AND C) SUB-REFLECTORS FOR FREQUENCY-REUSE TYPES OF SATELLITE COMMUNICATION SYSTEMS FOR COMMERCIAL AND DEFENSE APPLICATIONS

FIELD OF THE INVENTION

The invention is generally related to satellite communications systems which employ dichroic subreflectors, and, more particularly, to a three-dimensional frequency selective surface (FSS) subreflector configuration which permits handling of communications in the S and C bands.

BACKGROUND

Dichroic subreflectors are frequently used in satellite communication systems to achieve savings of both cost and space. These savings are achieved by using the same optics, but with two different feed horns operating at the two desired frequencies. FIG. 1 shows an example where a feed horn 1 is positioned adjacent the main reflector and is directed at the FSS subreflector, and where a feed horn 2 is positioned on an opposite side of the FSS subreflector and is directed toward feed horn and the main reflector through the FSS subreflector. Frequency selective surfaces are used to design dual-frequency sub reflectors that reflect one frequency while transmitting the other, enabling one to use the same main reflector for both frequencies.

The design of dual band subreflectors is relatively easy when the two frequency bands are separated widely from each other, as for instance in the case of S- and X-bands, for which the typical specifications are listed in Table-1 below.

TABLE-1

| Frequency | Center frequency | FSS transmission |
|---|---|---|
| S-band (2-2.3 GHz) | 2.15 GHz | <−10 dB |
| X-band (8-8.5 GHz) | 8.25 GHz | >−0.5 dB |

However, the same is not true when the two frequency bands are contiguous, as for instance S and C bands, for which the specifications may be of the type shown in Table 2 below.

TABLE-2

| Frequency | Center frequency | FSS transmission |
|---|---|---|
| S-band (1.76-2.4 GHz) | 2.08 GHz | >−0.5 dB |
| C-band (3.4-4.2 GHz) | 3.8 GHz | <−15 dB |

Although many papers have been published [1]-[9] which deal with the problem of designing dual- and triple-band subreflectors for satellite communications, a thorough search reveals that none could be used to design a subreflector so that it meets the specifications given in Table-2. Furthermore, many papers point out the difficulty encountered while attempting to design dual-band subreflectors when the two frequency bands are close to each other, let alone when they are contiguous. This is primarily because none of the FSS elements that have been used in the past for dual band subreflector designs perform satisfactorily when one attempts to employ them for the problem of meeting the specifications given in Table 2.

FIG. 2 shows in panels (a) and (b) the configuration of a conventional dual band reflector used for S-band and X-band transmissions as set forth in Table 1. As can be seen in panel (a) the S-band antenna is directed at the main reflector through the FSS subreflector, while the X-band antenna is directed at the FSS subreflector. Prior art FSS subreflectors are constructed such that, as is shown in panel (b) of FIG. 2, transmissions in the S-band frequency transmit through the FSS subreflector and are then reflected by the main reflector, while X-band frequency transmissions are reflected by the subreflector and are then transmitted by the main reflector. This allows for cost and space savings as noted above. However, until the invention described herein, C-band and S-band frequencies could not be handled simultaneously in the same way because the FSS subreflectors simply were not designed to and could not separate closely spaced, contiguous, or overlapping frequencies.

SUMMARY

In one embodiment of the invention a frequency-reuse sub reflector is configured to meet the specifications presented in Table 2, and thus these new FSS elements may be used as dual-band (S and C) subreflectors for frequency-reuse types of satellite communications systems for commercial, research and defense applications.

According to the invention, a FSS sub-reflector for a dual band reflector antenna having an S-band antenna configured to transmit at a frequency of 1.76 to 2.4 GHz and a C-band antenna configured to transmit at a frequency of 3.4 to 4.3 Ghz, includes a wave guide having a length which extends from a first end to a second end. There are two crossed dipoles, wherein a first crossed dipole is positioned at the first end of the waveguide and a second crossed dipole is positioned at the second end of the waveguide. Two parallel wire transmission lines connect the two crossed dipoles. An insulative substrate forms part of said waveguide, and preferably the outer surfaces of the insulative substrate are sheathed in metal. The FSS surface sub-reflector is configured to permit the S-band antenna to transmit through said frequency selective surface sub-reflector with an insertion loss of less than 0.5 decibels, and to reflect transmissions of the C-band antenna with transmissions through the frequency selective surface sub-reflector being less than 15 decibels.

The design is three-dimensional in nature. The FSS element can be fabricated by using multilayer printed circuit technology.

DETAILED DESCRIPTION

The specifications for a dual band, S-band and C-band, system call for the S-band to be transmitting with an insertion loss of less than 0.5 dB, while high reflection is desired in the C band, transmission less than −15 dB, as per the specifications given in Table-2 above. Typically, multi-layered frequency selective surfaces (FSSs) are designed to meet the specifications of the subreflectors for frequency reuse systems. Search for prior art reveals that previous multi-band designs cover frequency bands that are widely separated, as for instance S-, X- and Ka-bands. However, the existing designs cannot be adapted to meet the dual-band (S- and C-band) specifications, because there is no gap between the two bands, i.e., they are contiguous. Hence, the transition from the S- to C-band must be very sharp.

A sub reflector for this use is realized with an FSS which transmits the S-band with little loss, while reflecting the C-band as fully as possible. The key to achieving the desired frequency response is to combine two types of FSS elements, the first of which provides the passband at S-band but with a sharp roll-off as there is a transition into the C-band. It employs a three-dimensional element comprising: (i) a finite-length truncated waveguide of square cross-section; (ii) two cross-dipoles; (iii) two parallel-wire transmission lines connecting the dipoles above and below. The parameters of each of these components may be optimized to realize the desired frequency response characteristics.

Figure 1:
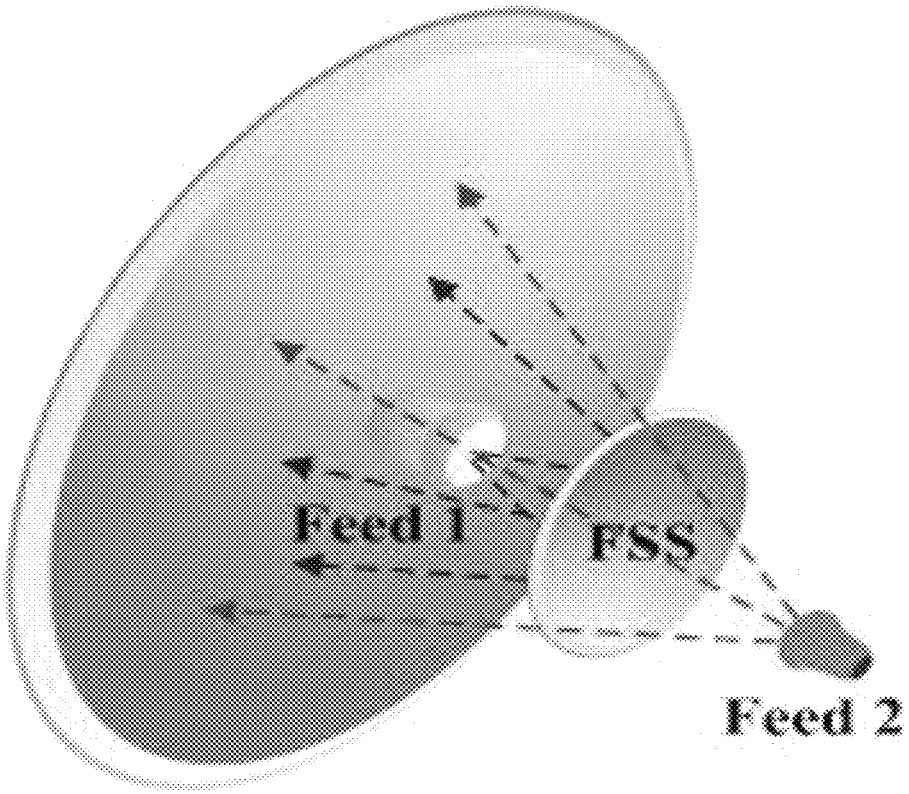
FIG. 1 is a drawing of a dual band antenna with a dichroic subreflector.
Figure 3:
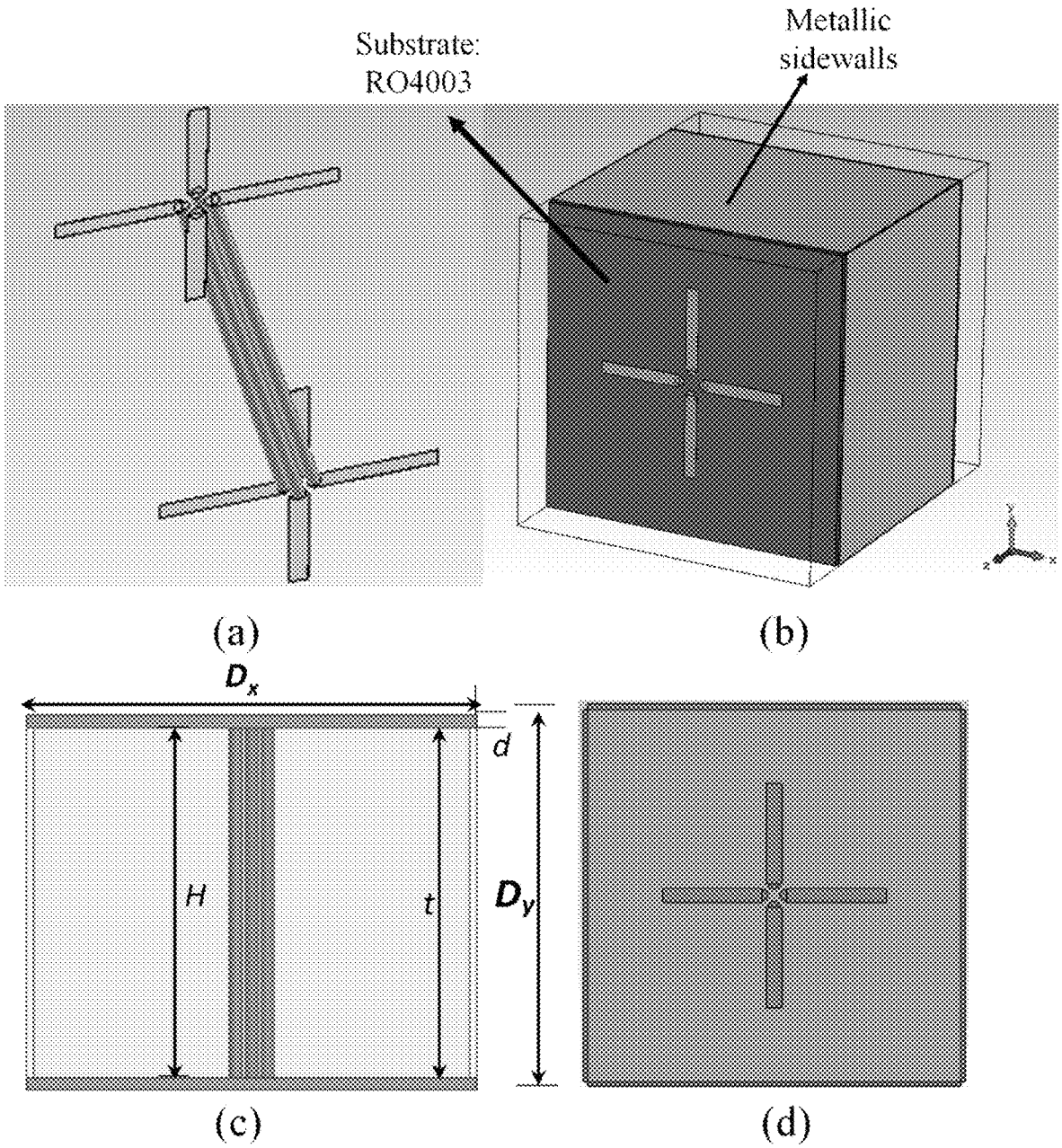
FIG. 3 schematically shows the FSS geometry of the FSS subreflector of the present invention where panel (a) shows a single element perspective view, panel (b) shows the full FSS geometry perspective view, panel (c) is a side view, and panel (d) is a top view.
Figure 4:
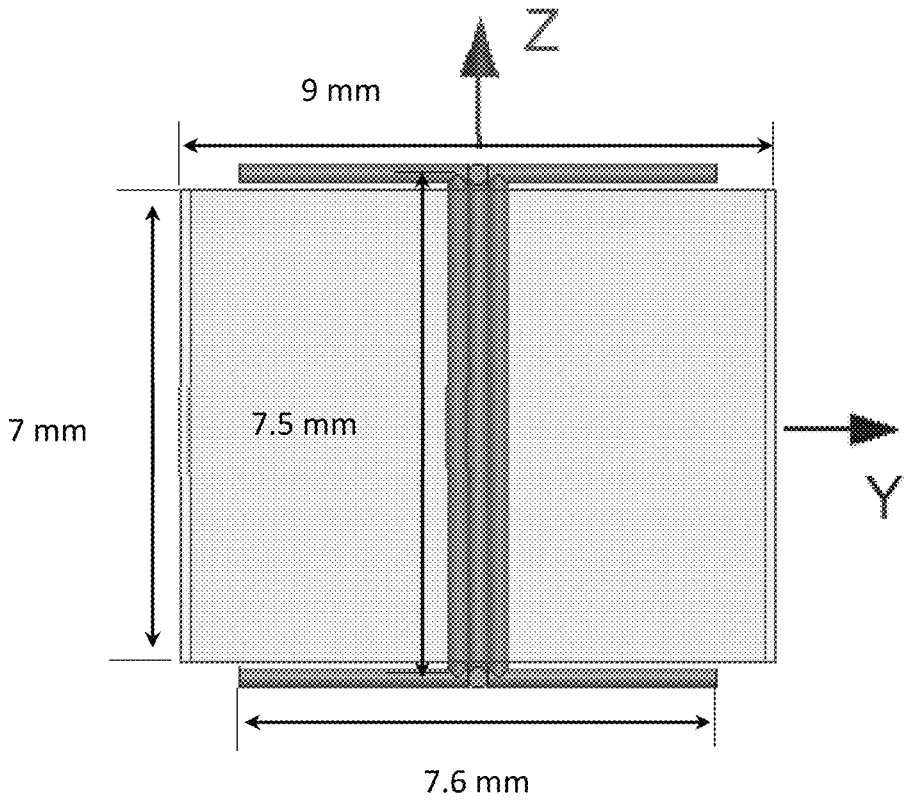
FIG. 4 is a cut away side view of an FSS subreflector showing exemplary dimensions.
Figure 5:
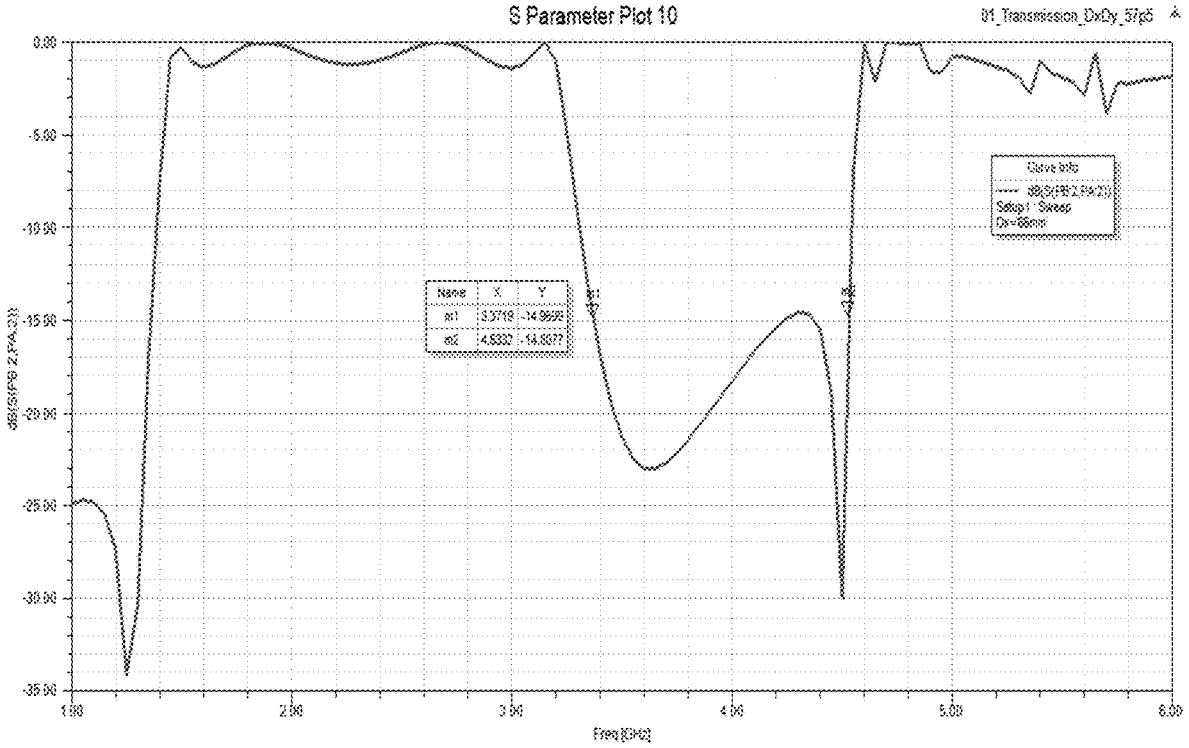
FIGS. 5 and 6A-C are plots of the frequency response of an FSS designed to meet the specifications in the S and C bands.
Figure 6A:
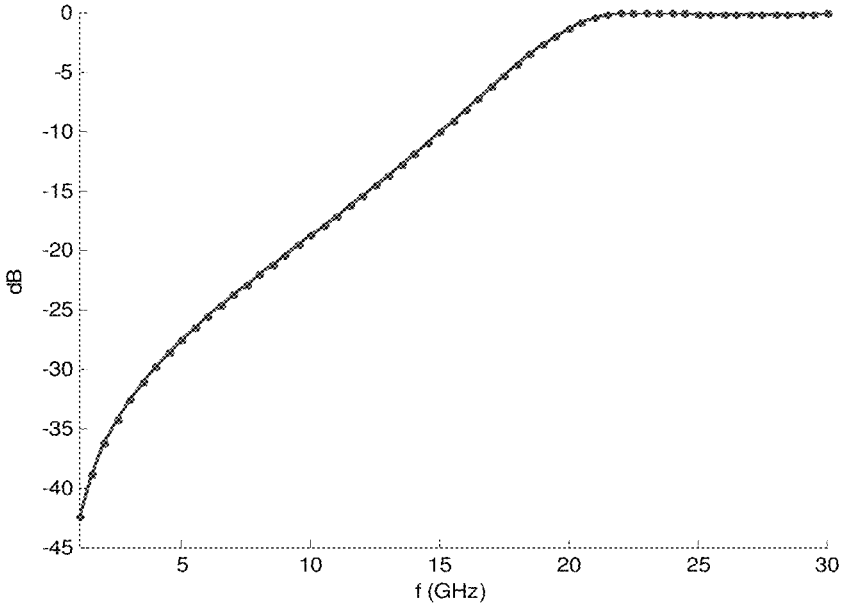
Figure 6B:
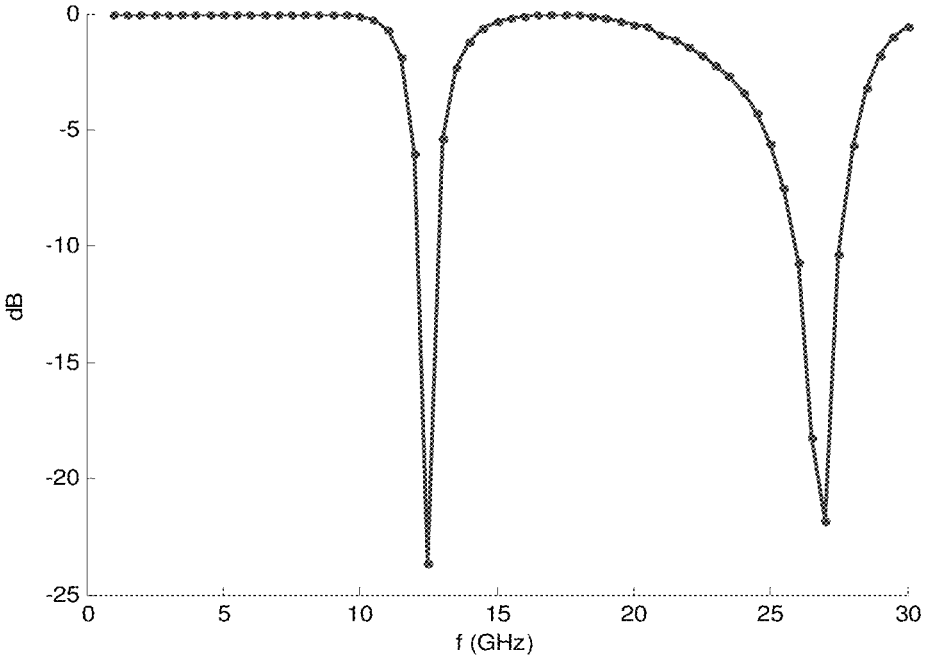
Figure 6C:
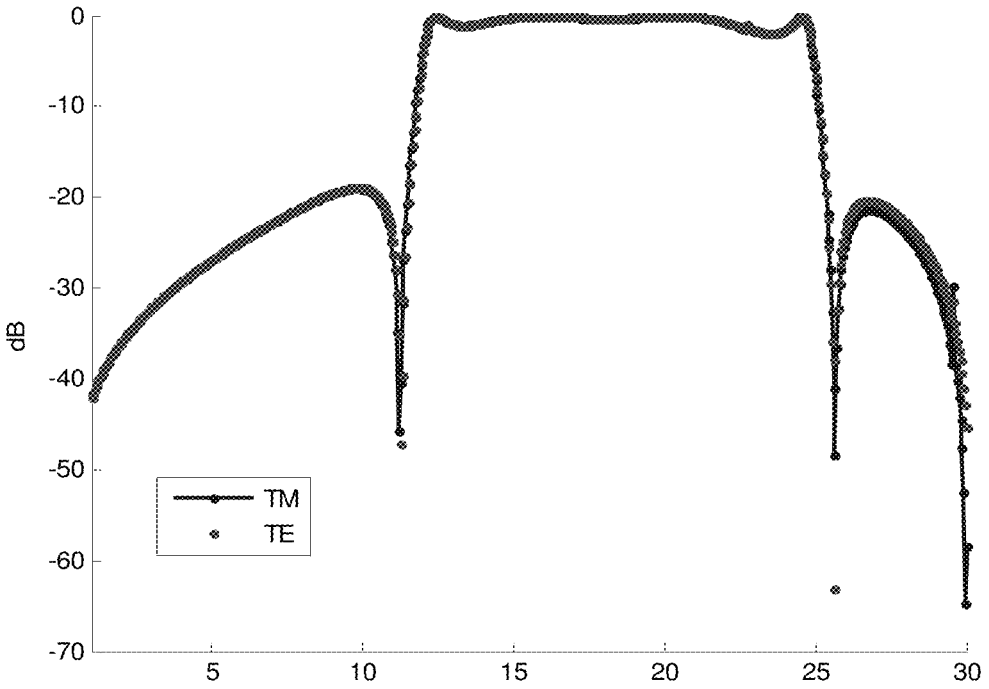

FIG. 3 shows in panels (a)-(d) the three dimensional configuration of an embodiment of the FSS subreflector. It can be seen in panel (a) that there are two cross-dipoles that are spaced apart and are aligned with each other as shown. Each branch of each dipole is electrically connected. This is accomplished by using two parallel wire transmission lines connected above and below. Panel (b) shows that the waveguide has a low-loss substrate, such as Rogers RO4003 (a glass and ceramic high frequency circuit, laminate material available from Rogers Corporation), and its sidewalls are metallic. The function of the substrate is to support the cross-dipoles. Examples of suitable metal materials include copper, which is preferred over other materials that have higher loss. The function of the metal sheathing is to provide a structure which guides the wave from the top pair of crossed dipoles to the bottom ones. The waveguide of panel (b) is a square, which conforms to the geometry of the unit cell. Panels (c) and (d) show that the cross-dipoles are positioned on opposite ends of the waveguide. As shown in panels (a), (c), and (d) the cross dipoles are aligned such that each branch of each dipole on each end are parallel. Panel (d) shows that electrical pathways connecting each branch of each dipole extend through the substrate. The FSS subreflector is gently curved so that it mimics the shape of the subreflector shown in FIG. 1. The FSS subreflector may be fabricated by using 3D printing technology. FIG. 4 shows exemplary dimensions of the FSS subreflector. In particular, the length of the substrate in the waveguide may be about 7 mm long, and the length to the center of the metalizations that make up the cross-dipoles may be about 7.5 mm long. The length of each sidewall may be about 9 mm. Thus, the volume of the waveguide may be about 567 $mm^3$. The end-to-end length of each dipole of the cross-dipoles can be 7.6 mm. Thus, the length of the dipole is less than the length of the substrate on a side.

Figure 2:
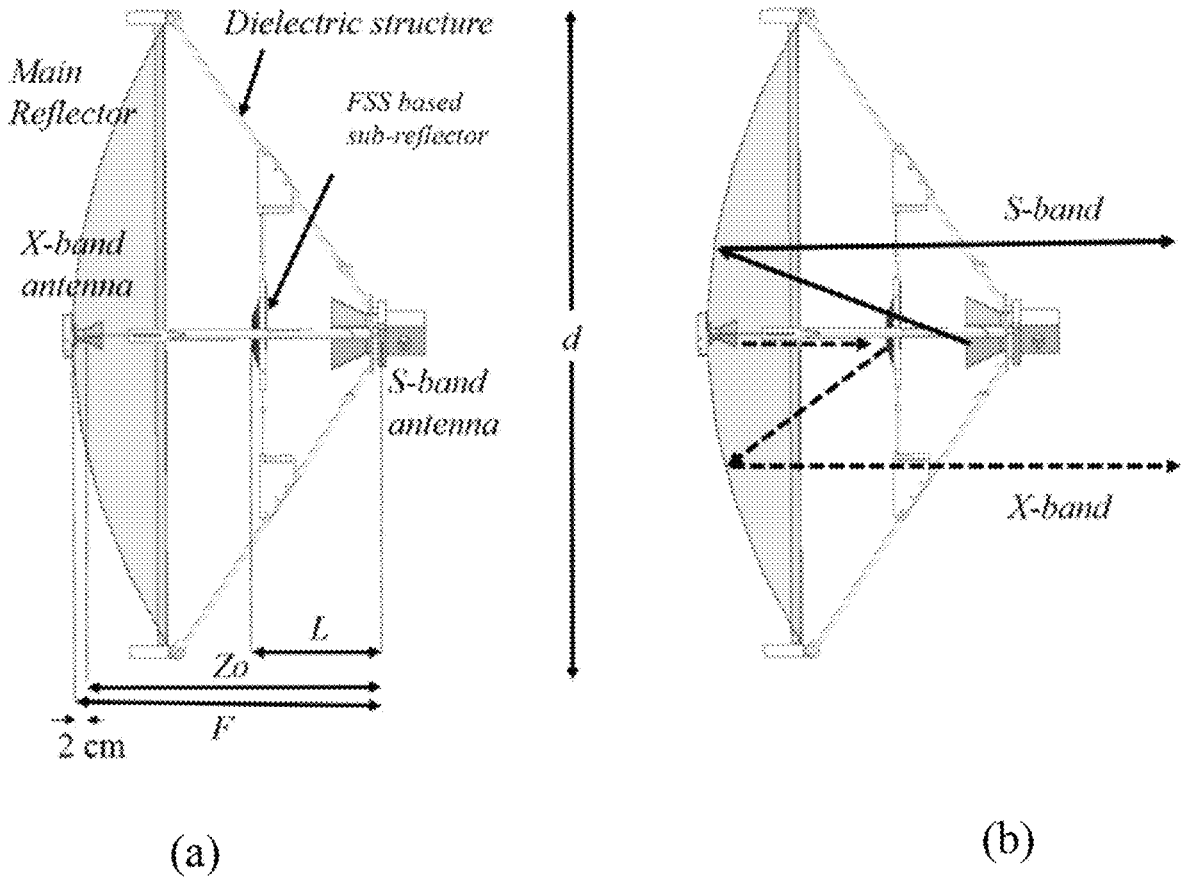
FIG. 2 shows a conventional dual band antenna which transmits in the S-band and X-band, and includes an FSS subreflector.

A dual band reflector antenna according to the present invention will be the same as shown in FIG. 2 except that the FSS subreflector will be as described above and shown in FIGS. 3*a-d*, and C-band antennal will substitute for the X band antenna at the main reflector. That is, the dual band reflector antenna will have a main reflector, an S-band antenna configured to transmit at a frequency of 1.76 to 2.4 GHz directed towards the main reflector, and a C-band antenna configured to transmit at a frequency of 3.4 to 4.3 GHz directed away from said main reflector and towards said S-band antenna. The frequency selective surface sub-reflector positioned between said S-band antenna and said C-band antenna will be configured to permit the S-band antenna to transmit through said frequency selective surface sub-reflector with an insertion loss of less than 0.5 decibels, and to reflect transmissions of the C-band antenna with transmissions through the frequency selective surface sub-reflector being less than 15 decibels. As shown in FIGS. 3*a-d*, the frequency selective surface sub-reflector will have a wave guide having a length which extends from a first end to a second end, two crossed dipoles, wherein a first crossed dipole of said two crossed dipoles is positioned at the first end of the waveguide and a second crossed dipole of said two cross dipoles is positioned at the second end of the waveguide, and two parallel wire transmission lines connecting the two crossed dipoles.

FIGS. 5 and 6*a-c* present a typical frequency response characteristic of an FSS designed to meet the specifications across the two frequency bands of interest, namely S and C, to demonstrate the feasibility of the proposed design.

REFERENCES

[1]. V. Agrawal and W. Imbriale, "Design of a dichroic Cassegrain subreflector," in IEEE Transactions on Antennas and Propagation, vol. 27, no. 4, pp. 466-473, July 1979, doi: 10.1109/TAP.1979.1142119.

[2]. A. Cha, C. Chen and D. Nakatani, "An offset Cassegrainian reflector antenna system with a frequency selective sub reflector," 1975 Antennas and Propagation Society International Symposium, Urbana, Ill., USA, 1975, pp. 97-100, doi: 10.1109/APS.1975.1147446.

[3]. Schennum, "Frequency-selective surfaces for multiple-frequency antennas," Engineering, 1973

[4]. Chao-Chun Chen, "Transmission of Microwave Through Perforated Flat Plates of Finite Thickness," in *IEEE Transactions on Microwave Theory and Techniques*, vol. 21, no. 1, pp. 1-6, January 1973, doi: 10.1109/TMTT.1973.1127906.

[5]. J. Montgomery, "Scattering by an infinite periodic array of thin conductors on a dielectric sheet," in IEEE Transactions on Antennas and Propagation, vol. 23, no. 1, pp. 70-75, January 1975, doi: 10.1109/TAP.1975.1141006.

[6]. B. Munk, R. Kouyoumjian and L. Peters, "Reflection properties of periodic surfaces of loaded dipoles," in IEEE Transactions on Antennas and Propagation, vol. 19, no. 5, pp. 612-617, September 1971, doi: 10.1109/TAP.1971.1139995.

[7]. E. Pelton and B. Munk, "A streamlined metallic radome," in IEEE Transactions on Antennas and Propagation, vol. 22, no. 6, pp. 799-803, November 1974, doi: 10.1109/TAP.1974.1140896.

[8]. B. Munk and R. Luebbers, "Reflection properties of two-layer dipole arrays," in IEEE Transactions on Antennas and Propagation, vol. 22, no. 6, pp. 766-773, November 1974, doi: 10.1109/TAP.1974.1140895.

[9]. R. Woo, "A low-loss circularly polarized dichroic plate," 1971 Antennas and Propagation Society International Symposium, Los Angeles, Calif., USA, 1971, pp. 149-152, doi: 10.1109/APS.1971.1150930.

The invention claimed is:

1. A dual band reflector antenna, comprising:

a main reflector;

an S-band antenna configured to transmit at a frequency of 1.76 to 2.4 GHz directed towards said main reflector;

a C-band antenna configured to transmit at a frequency of 3.4 to 4.3 GHz directed away from said main reflector and towards said S-band antenna; and a frequency selective surface sub-reflector positioned between said S-band antenna and said C-band antenna, wherein said frequency selective surface sub-reflector is configured to permit the S-band antenna to transmit through said frequency selective surface sub-reflector with an insertion loss of less than 0.5 decibels, and to reflect transmissions of the C-band antenna with transmissions through the frequency selective surface sub-reflector being less than 15 decibels, wherein said frequency selective surface sub-reflector comprises a wave guide having a length which extends from a first end to a second end, two crossed dipoles, wherein a first crossed dipole of said two crossed dipoles is positioned at the first end of the waveguide and a second crossed dipole of said two cross dipoles is positioned at the second end of the waveguide, and two parallel wire transmission lines connecting the two crossed dipoles.

2. The dual band reflector antenna of claim 1 wherein said frequency selective surface further comprising an insulative substrate as part of said waveguide.

3. The dual band reflector antenna of claim 2 wherein the insulative substrate comprises glass and ceramics.

4. The dual band reflector antenna of claim 2 further comprising a metal sidewalls on a plurality of sides of said insulative substrate.

5. The dual band reflector antenna of claim 1 wherein said waveguide of said frequency selective surface sub-reflector has four sides comprising two pairs of opposing sides where each pair of opposing sides are 9 mm apart, wherein said length of said waveguide is 7 mm, and wherein each of said two crossed dipoles includes a first dipole and a second dipole, and a length of said first dipole and said second dipole are each 7.6 mm.

6. The dual band reflector antenna of claim 5 wherein said frequency selective surface further comprising an insulative substrate forming part of said waveguide.

7. The dual band reflector antenna of claim 6 wherein the insulative substrate comprises glass and ceramics.

8. A frequency selective surface sub-reflector for a dual band reflector antenna having an S-band antenna configured to transmit at a frequency of 1.76 to 2.4 GHz and a C-band antenna configured to transmit at a frequency of 3.4 to 4.3 Ghz, comprising:

a wave guide having a length which extends from a first end to a second end;

two crossed dipoles, wherein a first crossed dipole of said two crossed dipoles is positioned at the first end of the waveguide and a second crossed dipole of said two cross dipoles is positioned at the second end of the waveguide;

two parallel wire transmission lines connecting the two crossed dipoles; and an insulative substrate forming part of said waveguide, wherein said frequency selective surface sub-reflector is configured to permit the S-band antenna to transmit through said frequency selective surface sub-reflector with an insertion loss of less than 0.5 decibels, and to reflect transmissions of the C-band antenna with transmissions through the frequency selective surface sub-reflector being less than 15 decibels.

9. The frequency selective surface sub-reflector of claim 8 wherein said waveguide of said frequency selective surface sub-reflector has four sides comprising two pairs of opposing sides where each pair of opposing sides are 9 mm apart, wherein said length of said waveguide is 7 mm, and wherein each of said two crossed dipoles includes a first dipole and a second dipole, and a length of said first dipole and said second dipole are each 7.6 mm.

10. The frequency selective surface sub-reflector of claim 8 wherein the insulative substrate comprises glass and ceramics.

11. The frequency selective surface sub-reflector of claim 8 further comprising a metal sidewalls on a plurality of sides of said insulative substrate.

* * * * *